US006910914B1

(12) United States Patent
Spink, Jr.

(10) Patent No.: US 6,910,914 B1
(45) Date of Patent: Jun. 28, 2005

(54) SHIELDED CABLE END CONNECTOR ASSEMBLY

(75) Inventor: William E. Spink, Jr., Woodland Hills, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/917,158

(22) Filed: Aug. 11, 2004

(51) Int. Cl.[7] ..... H01R 12/24

(52) U.S. Cl. ..... 439/497; 439/579; 439/606; 439/874

(58) Field of Search ..... 439/497, 579, 439/606, 874

(56) References Cited

U.S. PATENT DOCUMENTS 4,341,428 A * 7/1982 Hatch et al. ..... 439/372
4,508,415 A * 4/1985 Bunnell ..... 439/497
4,767,345 A * 8/1988 Gutter et al. ..... 439/92
5,314,361 A * 5/1994 Ney et al. ..... 439/874
5,480,327 A * 1/1996 Zola ..... 439/607
5,888,096 A * 3/1999 Soes et al. ..... 439/610
5,954,541 A * 9/1999 Ozai et al. ..... 439/608
6,102,747 A * 8/2000 Paagman ..... 439/701
6,217,374 B1 * 4/2001 O'Sullivan ..... 439/499
6,257,914 B1 * 7/2001 Comerci et al. ..... 439/357
6,648,676 B1 * 11/2003 Lee ..... 439/499
6,739,904 B2 * 5/2004 Wu ..... 439/497
6,824,426 B1 * 11/2004 Spink, Jr. ..... 439/579

* cited by examiner

*Primary Examiner*—Tho D. Ta
*Assistant Examiner*—Larisa Tsukerman
(74) *Attorney, Agent, or Firm*—Wei Te Chung

(57) ABSTRACT

A cable end connector assembly (1) includes an insulative housing (2), a number of contacts (3) assembled to the insulative housing in a back-to-front direction, a shielding member (5) assembled to the insulative housing, a cable (6) including a number of signal conductors (62) and drain wires (64) respectively soldered with the contacts, and an insulative cover (7) over-molding rear portions of the insulative housing and the shielding member and a front end of the cable. The housing includes an upper wall (21), a lower wall (22) and a pair of sidewalls (23) connecting with the upper and the lower walls. The shielding member includes a first and a second shielding halves (51, 52) respectively attached to the upper wall and the lower wall of the insulative housing.

11 Claims, 13 Drawing Sheets

SHIELDED CABLE END CONNECTOR ASSEMBLY

BACKGROUND OF THE INVENTION

1. Field of the Invention

The present invention relates to a cable end connector assembly, and particularly to a shielded cable end connector assembly.

2. Description of Related Art

Serial ATA is an evolutionary replacement of the parallel ATA storage interface in the desktop as well as the cost-sensitive server and network storage market segments. The specification of Serial ATA allows for thinner, more flexible cables and lower pin counts. A conventional Serial ATA connector assembly comprises an insulative housing defining an L-shaped receiving space, a plurality of contacts received in the housing with tail portions exposed beyond the housing, a cable having a plurality of signal conductors and grounding drain wires respectively soldered with the tail portions of the contacts, and an insulative cover over-molded with a rear end of the housing. The cable for signal transmission comprises twin axial or parallel pair subassemblies. Each subassembly includes a pair of insulated signal conductors and a pair of non-insulated grounding drain wires besides the two signal conductors. A layer of conductive shielding is wrapped around the pair of signal conductors and the drain wires so that it is in electrical contact with the drain wires. An optional jacket is covered over the pair of conductive shieldings. Serial ATA cable connector assembly is often used to transmit high speed signals, therefore, shielding demand is relatively high. However, current structure of a Serial ATA cable connector assembly has no shielding protection to the housing portion.

Hence, a cable end connector assembly with a quick assembled shielding member for better shielding protection is highly desired.

SUMMARY OF THE INVENTION

An object of the present invention is to provide a cable end connector assembly having quick-assembled shielding member for providing better shielding protection to the signal transmission.

To achieve the above object, a cable end connector assembly in accordance with the present invention comprises an insulative housing, a plurality of contacts assembled to the insulative housing in a back-to-front direction of the insulative housing, a shielding member assembled to the insulative housing, a cable comprising a plurality of signal conductors and drain wires respectively soldered with the contacts and an insulative cover over-molded with rear portions of the insulative housing and the shielding member and a front end of the cable. The shielding member comprises a first and a second shielding halves respectively attached to an upper and a lower walls of the insulative housing and over-molded by the insulative cover.

Other objects, advantages and novel features of the invention will become more apparent from the following detailed description when taken in conjunction with the accompanying drawings.

DETAILED DESCRIPTION OF THE INVENTION

Figure 1:
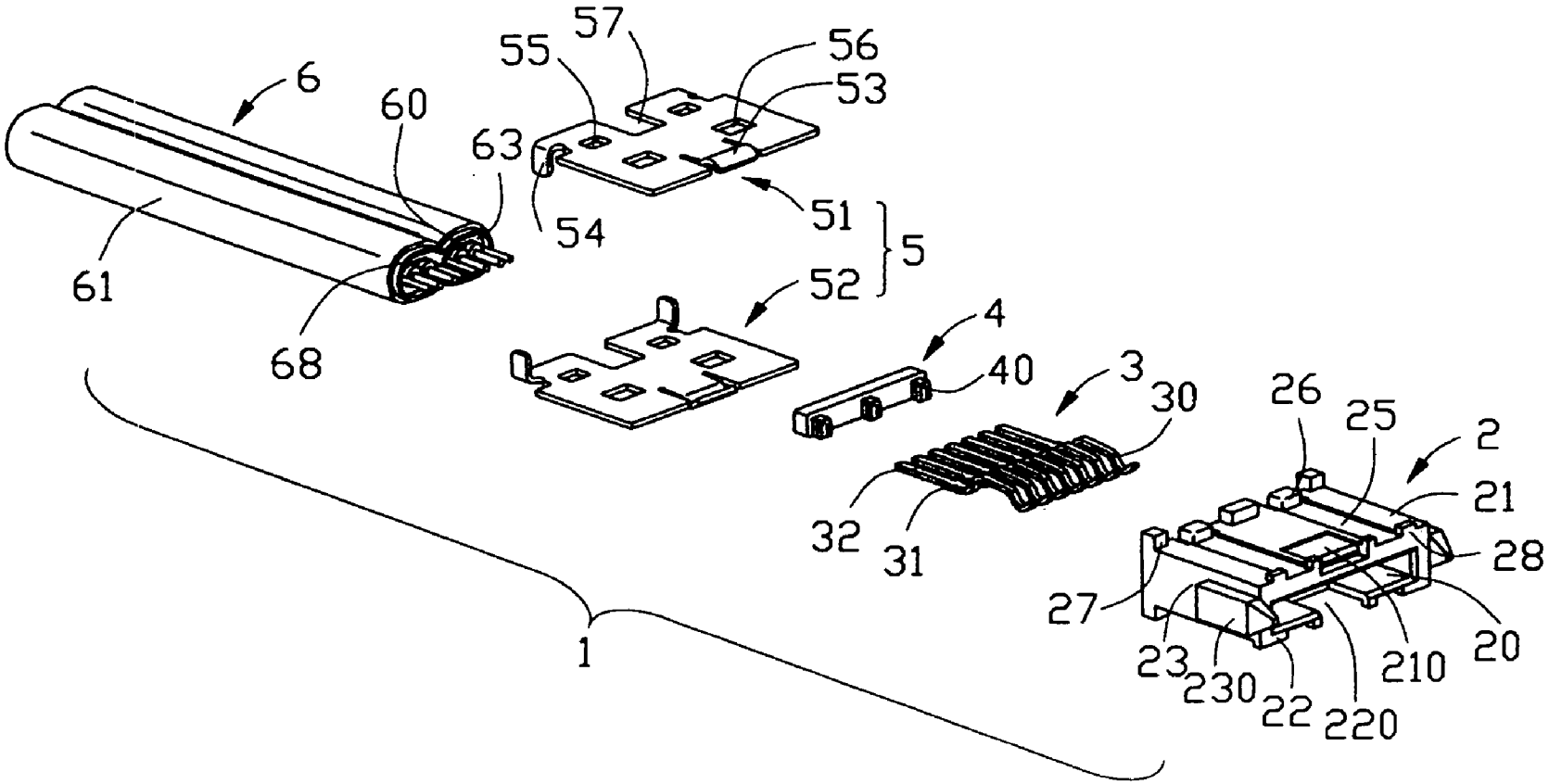
FIG. 1 is an exploded, perspective view of a cable end connector assembly of a first embodiment in accordance with the present invention, without a cover-molded thereon.
Figure 2:
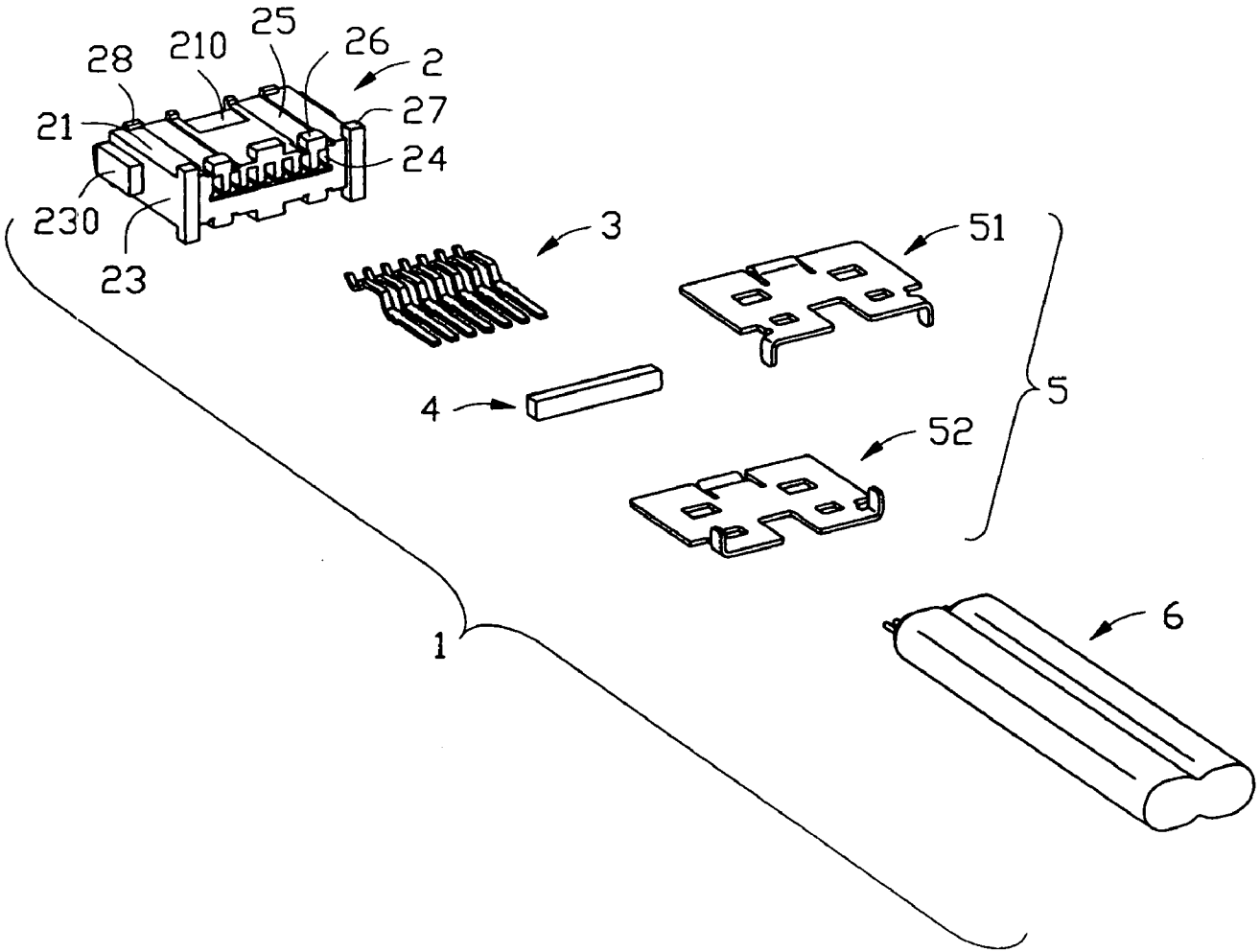
FIG. 2 is a view similar to FIG. 1, but taken from a different aspect.
Figure 7:
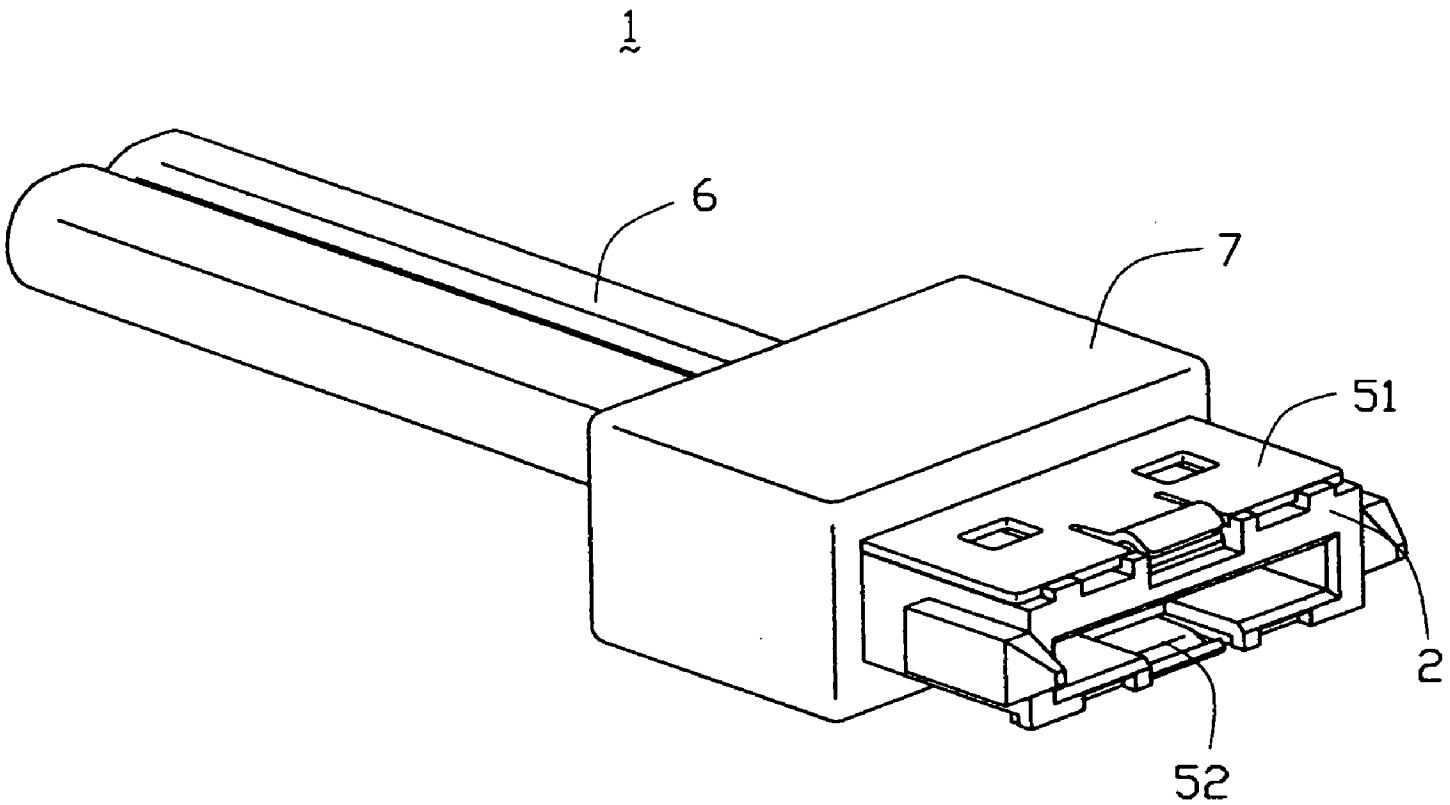
FIG. 7 is a view similar to FIG. 5 with the cover over-molded thereon.
Figure 8:
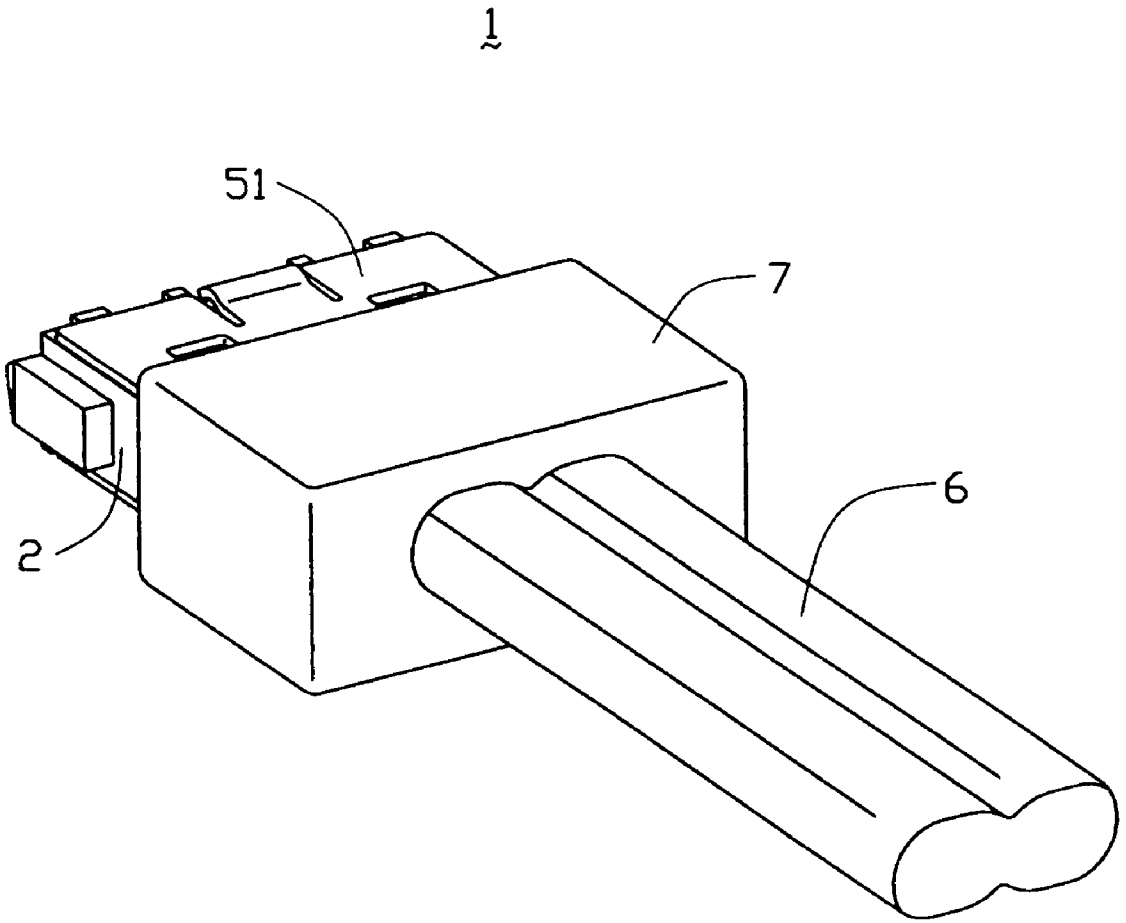
FIG. 8 is a view similar to FIG. 7, but taken from a different aspect.
Figure 9:
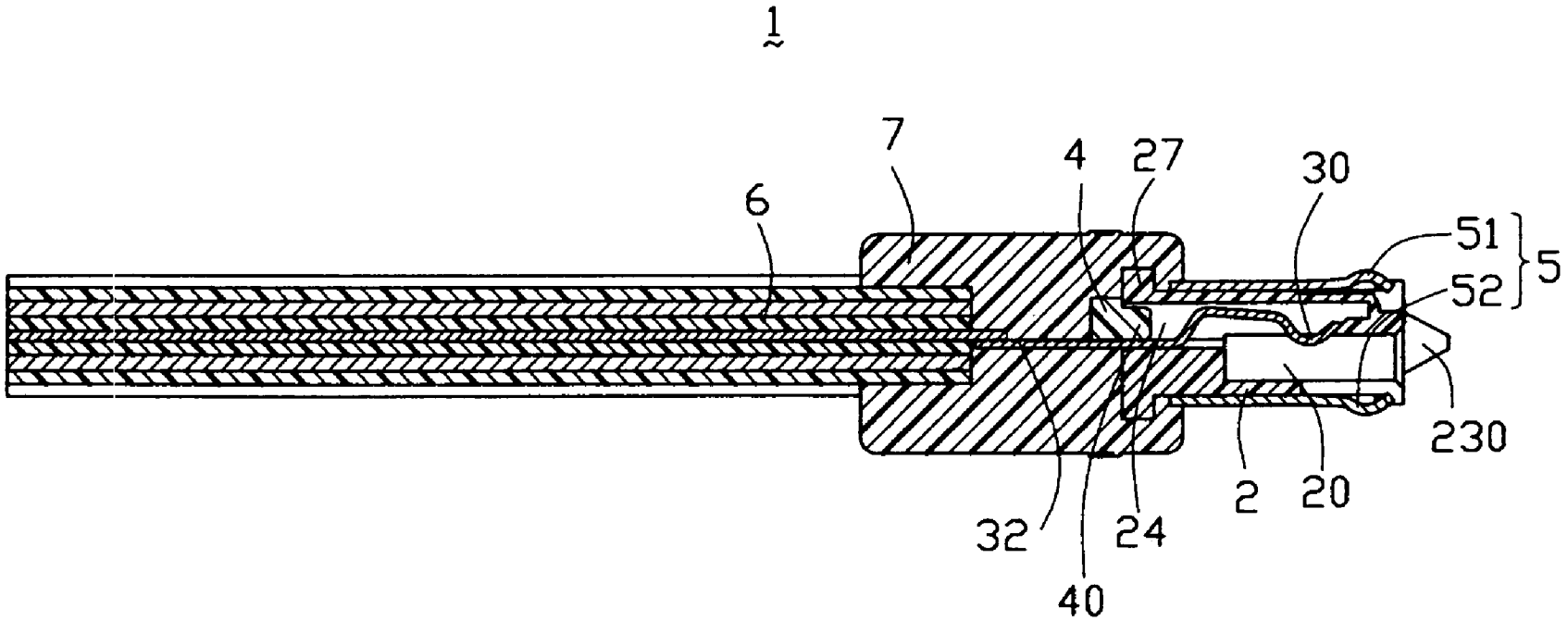
FIG. 9 is a cross-sectional view taken along lines 9—9 of FIG. 7.
Figure 10:
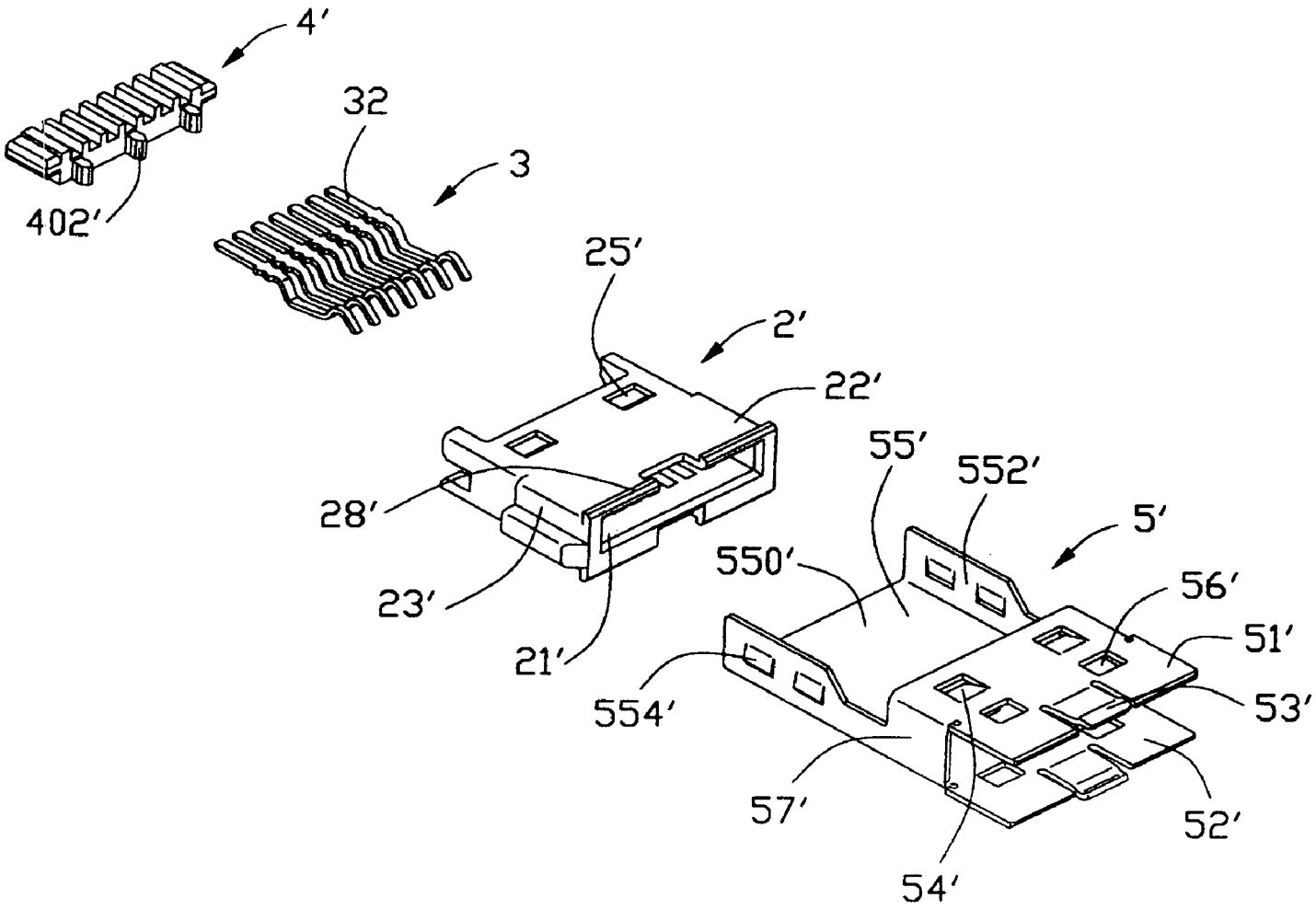
FIG. 10 is a partially exploded, perspective view of a cable end or assembly of a second embodiment of the present invention.
Figure 11:
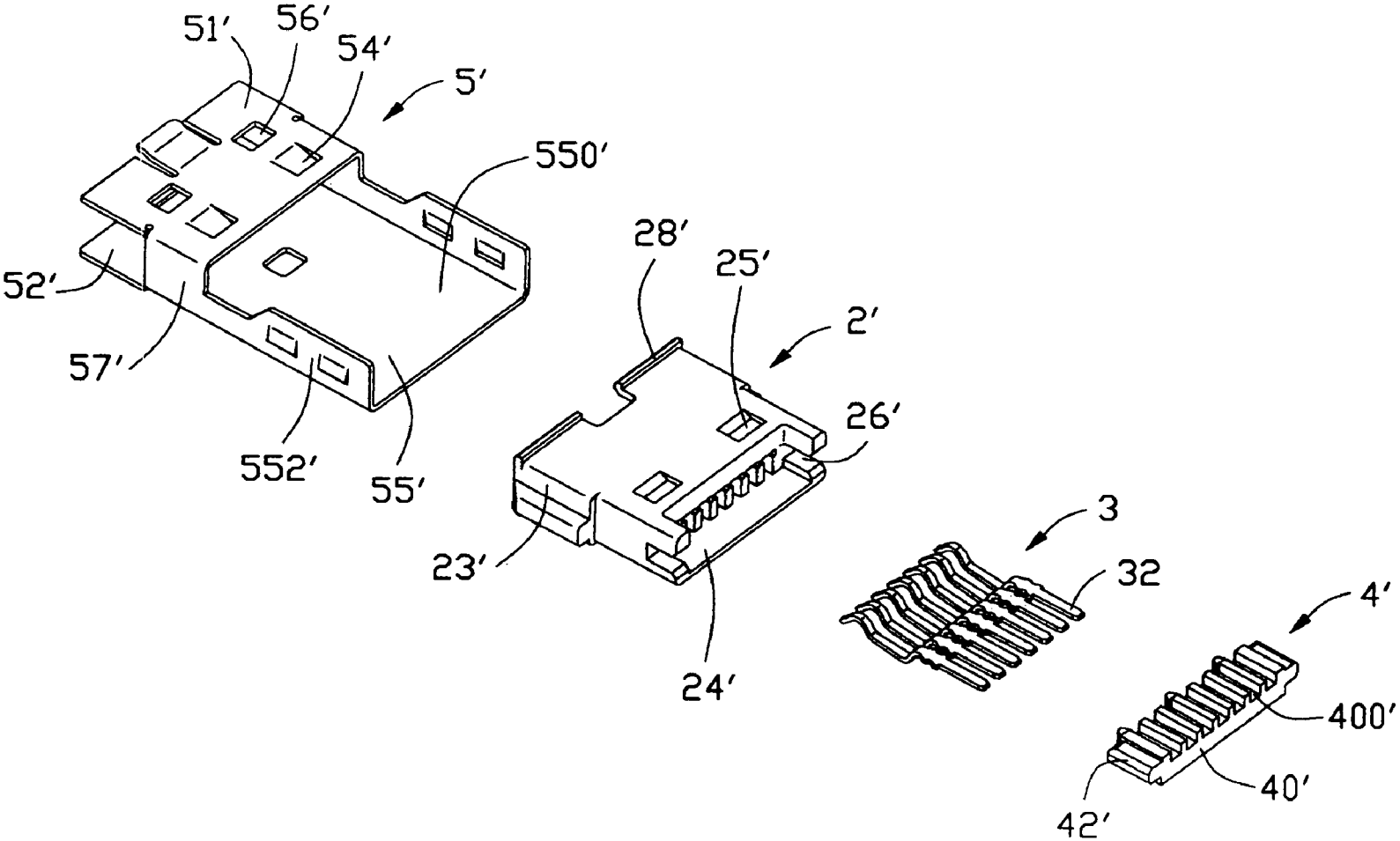
FIG. 11 is a view similar to FIG. 10, but taken from a different aspect.

Referring to FIGS. 1–2 in conjunction with FIGS. 7–9, a cable end connector assembly 1 in accordance with the present invention comprises an insulative housing 2, a plurality of contacts 3, a spacer 4, a shielding member 5, a cable 6 and an insulative cover 7.

Referring to FIGS. 1–2, the insulative housing 2 comprises a relatively thicker upper wall 21, a relatively thinner lower wall 22 opposite to the upper wall 21 and a pair of sidewalls 23 connecting with the upper and the lower walls 21, 22. A rectangular receiving space 20 is circumscribed by the upper wall 21, the lower wall 22 and the sidewalls 23. A plurality of passageways 24 is defined forwardly from a rear face of the housing 2 and extends in the upper wall 21. A rectangular depression 210 is defined in a front middle portion of the upper wall 21 and a rectangular cutout 220 is defined in a front middle portion of the lower walls 22 corresponding to the depression 210. Each of the upper and the lower walls 21, 22 define a pair of elongate channels 25 extending rearwardly from a front face to the rear face of the housing 2 and respectively located at opposite sides of the depression 210 and the cutout 220. Each channel 25 is formed with a first projection 26 adjacent to the rear face of the housing 2. A plurality of second projections 27 are respectively formed on the upper and the lower walls 21, 22 adjacent to the rear face of the housing 2. The second projections 27 are respectively formed at opposite ends of the housing 2 and between the pair of the first projections 26. Each of the upper and the lower walls 21, 22 is also formed with a plurality of third projections 28 adjacent to the front face of the housing 2 and located at opposite sides of the channels 25. Each sidewall 23 forms a guiding portion 230 thereon with a tapered end extending beyond the front face of the housing 2.

Each contact 3 comprises a curved contacting portion 30, a tail portion 32 and a retention portion 31 interconnecting the contacting portion 30 and the tail portion 32.

The spacer 4 is a rectangular bar and forms a plurality of blocks 40 on a front surface thereof.

The shielding member 5 comprises a first shielding half 51 and a second shielding half 52 having the same structure as that of the first shielding half 51. Each shielding half 51, 52 is a flat sheet member and forms a curved tongue portion 53 in a front middle portion thereof and a pair of wing portions 54 bending vertically from opposite sides of a rear portion thereof. A pair of first notches 55 is defined in the rear portion of the shielding half 51, 52 corresponding to the first projections 26 of the insulative housing 2. A pair of second notches 56 is defined in the front portion of the shielding half 51, 52 and substantially aligns with the first notches 55 along a front-to-back direction. A plurality of openings 57 are respectively defined in the rear portion of the shielding half 51, 52 corresponding to the second projections 27 of the insulative housing 2.

Figure 3:
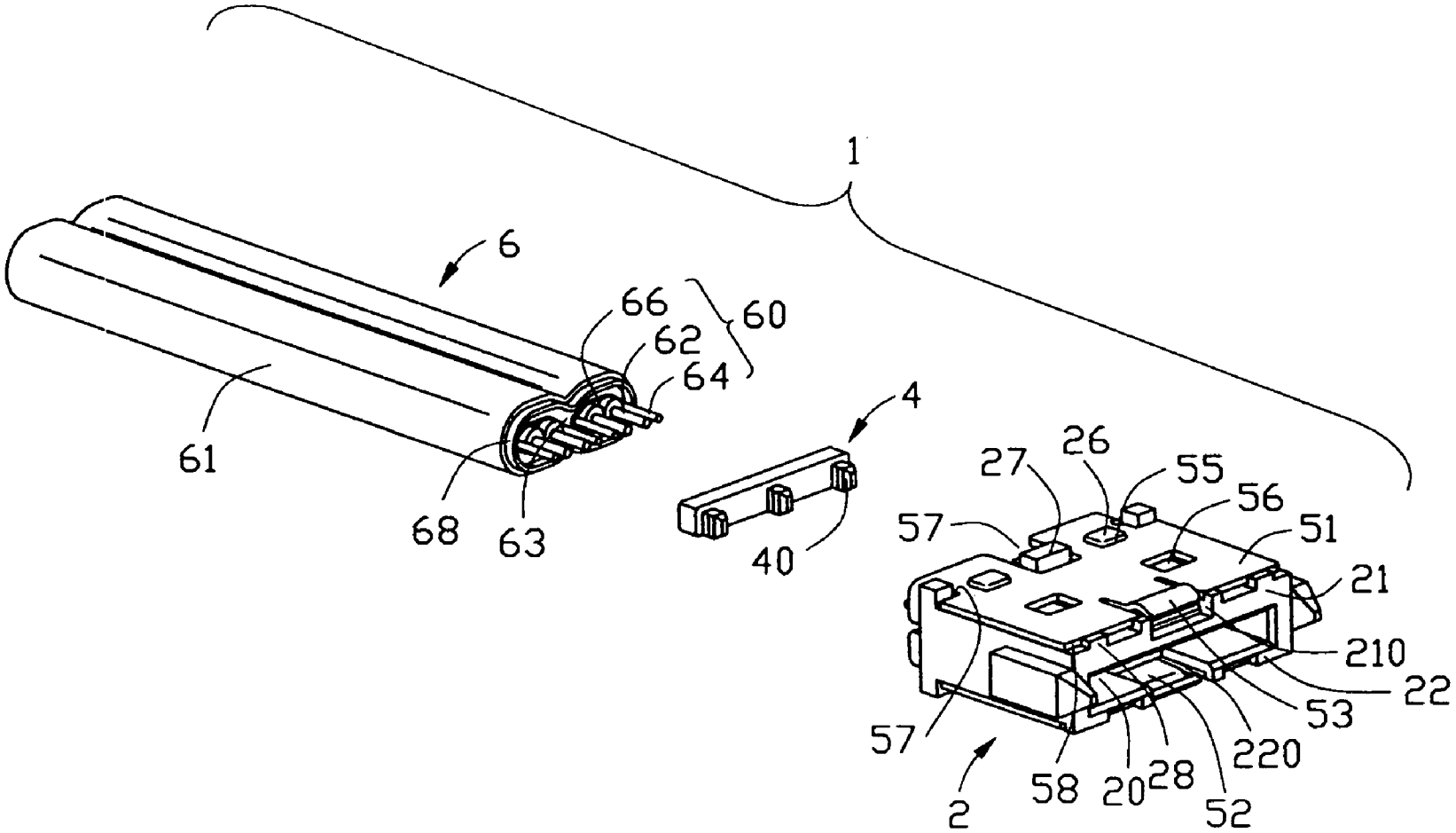
FIG. 3 is a partially assembled view of FIG. 1.

In conjunction with FIG. 3, the cable 6 for signal transmission comprises a pair of parallel subassemblies 60, an inner insulative jacket 63 covering the pair of subassemblies 60, a grounding braid 68 wrapping the inner insulative jacket 63 and an outer insulative jacket 61 surrounding the grounding braid 68. Each subassembly 60 includes a pair of insulated signal conductors 62, a pair of non-insulated grounding drain wires 64 beside the two signal conductors 62 and a layer of conductive shielding 66 wrapping around the signal conductors 62 and the drain wires 64. Front ends of the signal conductors 62 and the drain wires 64 are respectively exposed beyond the cable 6 for electrically connecting with the contacts 3.

Figure 4:
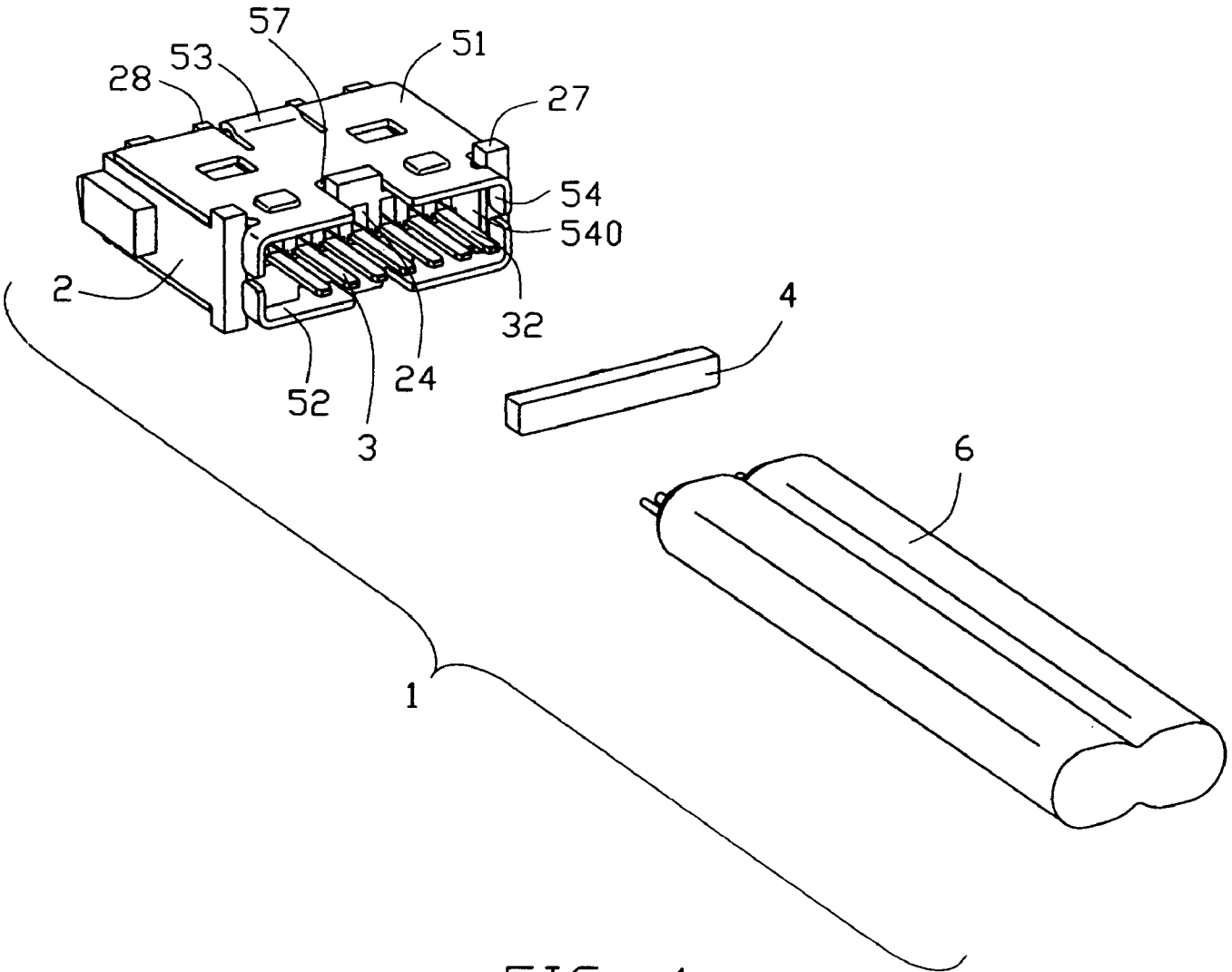
FIG. 4 is a view similar to FIG. 3, but taken from a different aspect.

Referring to FIGS. 3–4, in assembly, the contacts 3 are respectively assembled to the insulative housing 2 in a back-to-front direction. The contacts 3 are respectively received in the passageways 24 with the tail portions 32 exposed beyond the rear face of the housing 2 and the curved contacting portion 31 partially exposed in the receiving space 20. The shielding halves 51, 52 are respectively assembled to the upper and the lower walls 21, 22 of the insulative housing 2 in an up-to-down direction of the housing 2. The first and the second projections 26, 27 of the upper and the lower walls 21, 22 of the housing 2 are respectively received in the first notches 55 and the openings 57 with a front edge 58 of the shielding half 51, 52 abutting against the third projections 28. The tongue portions 53 of the shielding halves 51, 52 are respectively received in the depression 210 of the upper wall 21 and the cutout 220 of the lower wall 22. The wing portions 54 of the first and the second shielding halves 51, 52 are exposed beyond the rear face of the insulative housing 2 and together form a substantially close space 540.

Figure 5:
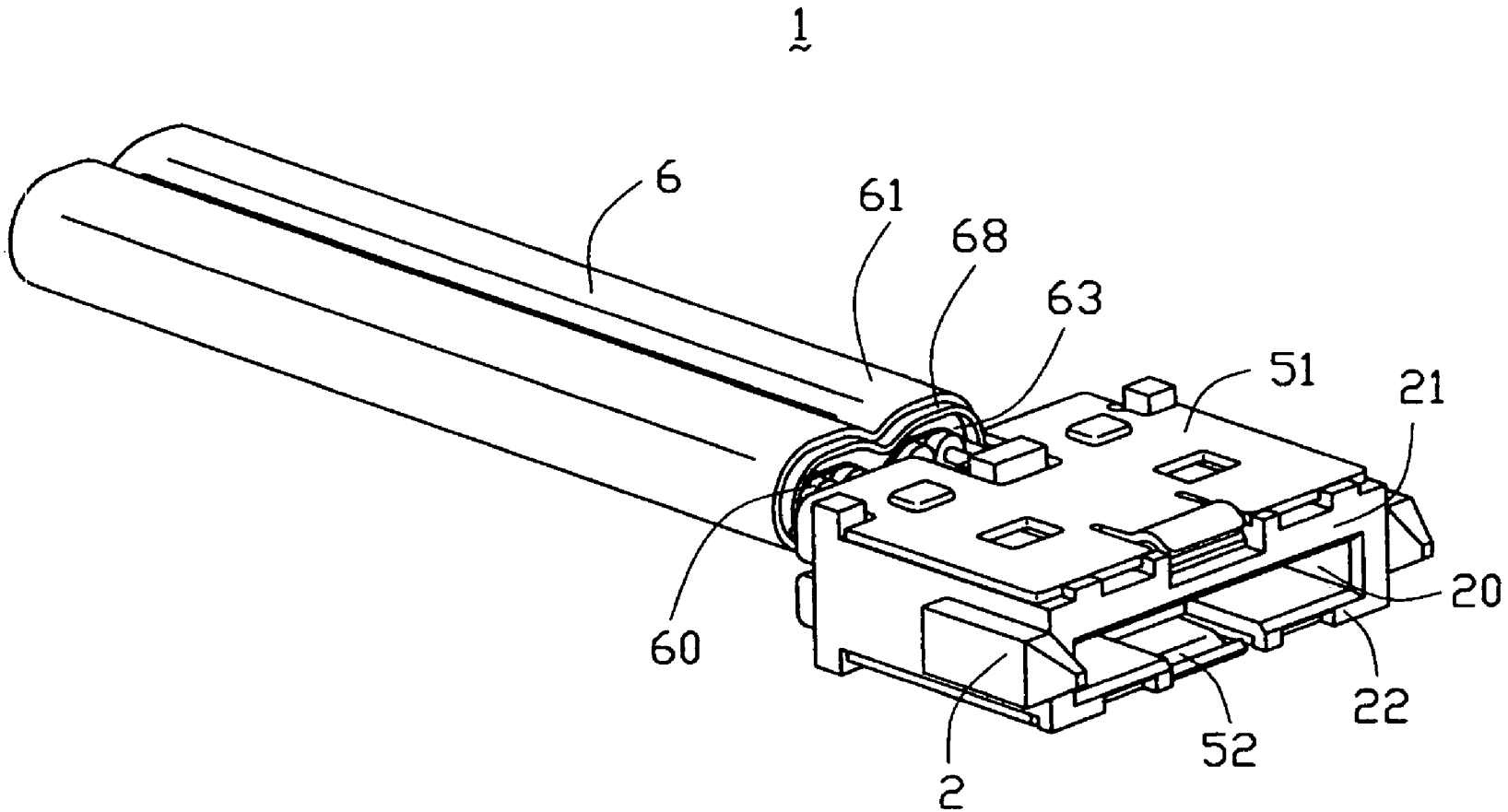
FIG. 5 is an assembled view of FIG. 3.
Figure 6:
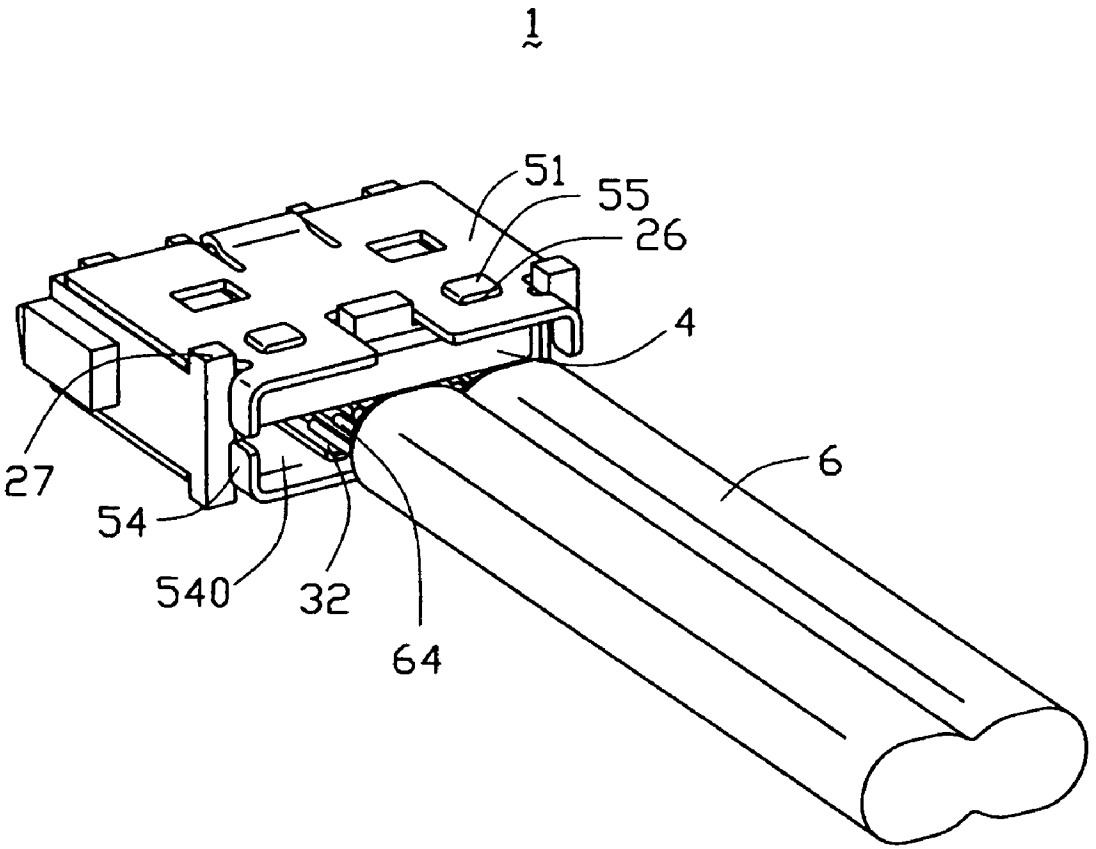
FIG. 6 is a view similar to FIG. 5, but taken from a different aspect.

Referring to FIGS. 5 and 6, the spacer 4 is assembled to the insulative housing 2 in the back-to-front direction with the blocks 40 thereof received in corresponding passageways 24 (referring to FIG. 9) for retaining the spacer 4 to the housing 2. The front ends of the signal conductors 62 and the drain wires 64 of the cable 6 are respectively soldered to the tail portions 32 of the contacts 3 exposing in the close space 540. Especially, the adjacent drain wires 64 of the pair of parallel subassemblies 60 are soldered to a common contact 3.

Referring to FIGS. 7–9, the insulative cover 7 is overmolding the rear portions of the shielding halves 51, 52, a rear portion of the insulative housing 2 and a front end of the cable 6. The second projections 27 of the insulative housing 2 increase the retaining force between the housing 2 and the cover 7.

A second embodiment of the present invention is shown in FIGS. 10–13. The main difference between the first and the second embodiments is that the shielding member 5' of the second embodiment is a unitary piece.

An insulative housing 2' of the second embodiment comprises a relatively thicker upper wall 21', a relatively thinner lower wall 22 and a pair of sidewalls 23' connecting with the upper and the lower walls 21', 22'. A pair of depressions 25' is defined in a rear portion of each of the upper and the lower walls 21', 22'. Each of the upper and the lower walls 21', 22' is provided with a blocking portion 28' extending vertically from a front edge thereof. A pair of rectangular blocks 24' respectively extend rearwardly from rear edges of the upper and the lower walls 21', 22' and together define a cavity 26'. The block 24' extending from the lower wall 22' is partially cutout for assembling the spacer 4' conveniently.

The spacer 4' comprises a rectangular body 40' and a pair of bars 42' extending vertically from opposite sides of the body 40'. A surface of the body 40' is slotted with a plurality of slots 400'. The body 40' is also provided with a plurality of blocks 42' extending forwardly from a front surface thereof.

The shielding member 5' comprises a first shielding half 51', a second shielding half 52' having the same structure as that of the first shielding half 51', a pair of sidewalls 57' vertically connecting rear edges of the first and the second shielding halves 51', 52', and a U-shaped extension portion 55' extending rearwardly from the second shielding half 52' and the pair of sidewalls 57'. Each shielding half 51', 52' have the substantial same structure as that of the shielding half 51, 52 and defines a pair of notches 56' in a front portion thereof. A pair of spring fingers 54' is formed in a rear portion of the shielding half 51' 52' and are respectively in alignment with the pair of notches 56' in a front-to-back direction. A curved tongue portion 53' is formed in a middle portion of the shielding half 51'; 52'. The extension portion 55' comprises a flat main portion 550' extending rearwardly from the second shielding half 52' and a pair of vertical portions 552' respectively extending rearwardly from the pair of sidewalls 57'. Each vertical portion 552' forms a pair of spring tabs 554' bending outwardly therefrom.

Figure 12:
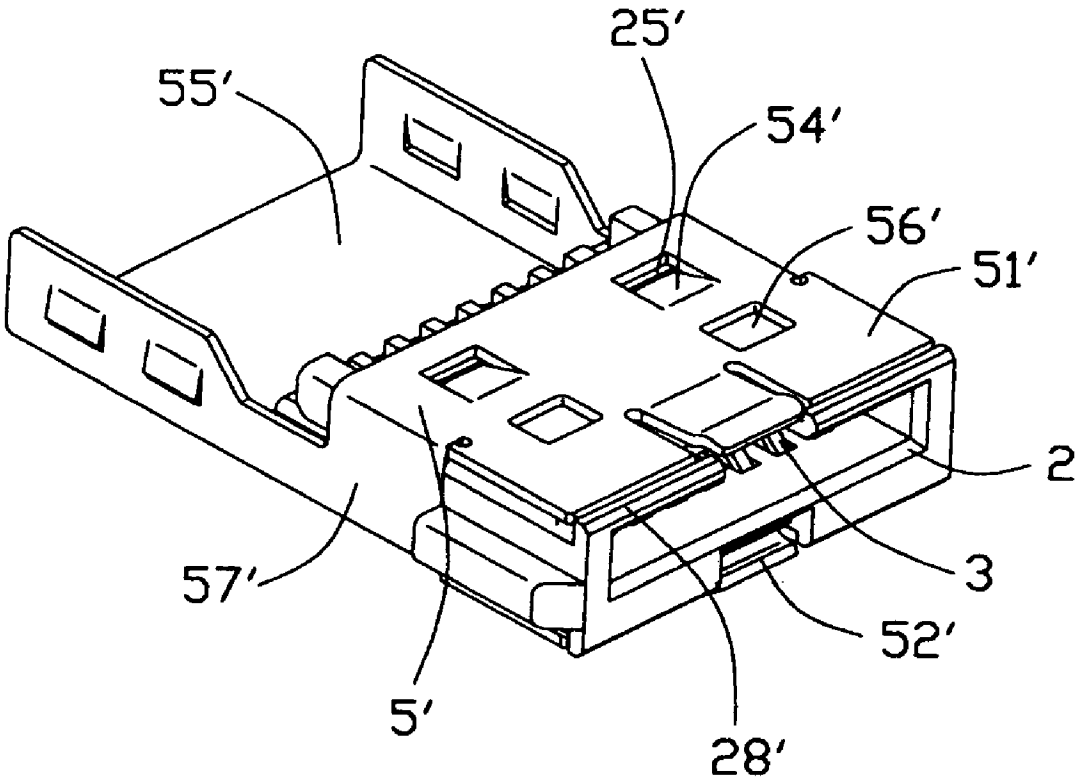
FIG. 12 is an assembled view of FIG. 10.
Figure 13:
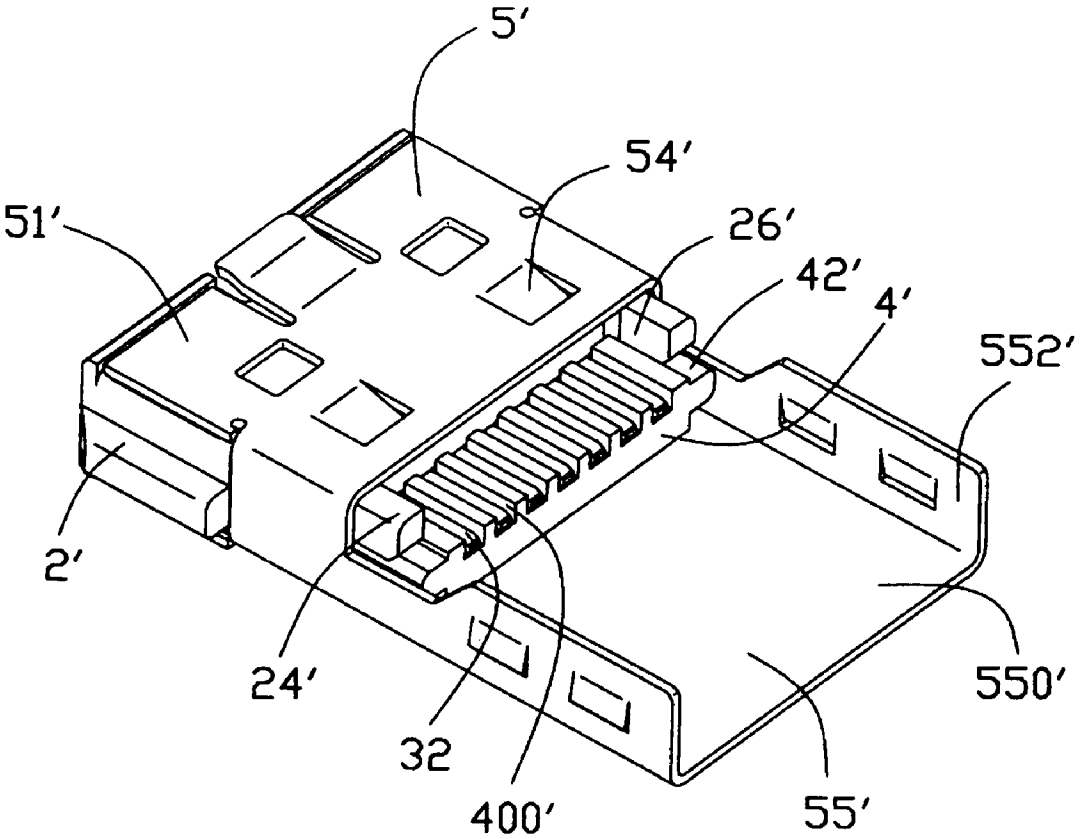
FIG. 13 is an assembled view of FIG. 11.

In assembly, referring to FIGS. 12 and 13 in conjunction with FIGS. 1–2, the contacts 3 are assembled to the insulative housing 2' with the tail portions 32 thereof exposed in the cavity 26'. The spacer 4' is then assembled to the insulative housing 2' with the pair of bars 42' sandwiched between the pair of blocks 24' and with the body 40' received in the cavity 26' and located on one of the blocks 24'. The tail portions 32 of the contacts 3 are respectively received in the slots 400' for being soldered with the conductors 62, 64 of the cable 6. The shielding member 5' is assembled to the insulative housing 5' in a front-to-back direction. The spring fingers 54' of the first and the second shielding halves 51', 52' respectively snap into the depressions 25' of the housing 2'. Front edges of the first and the second shielding halves 51', 52' abut against the blocking portions 28' of the housing 2' for preventing the shielding member 5' from moving forwardly. The extension portion 55' extends beyond the housing 2' for engaging with a strain relief (not shown) to shield the electrical connection between the conductors 62, 64 and the contacts 3. Therefore, the conductors 62, 64 of the cable 6 and the tail portions 32 of the contacts 3 are supported by the extension portion 55' of the shielding member 5'. The insulative cover 7 is then over-molded with a rear portion of the housing 2', the strain relief, the extension portion 55', and the tail portions 32 and the conductors 62, 64.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly, comprising:

an insulative housing comprising an upper wall, an opposite lower wall and a pair of sidewalls connecting with the upper and the lower walls, the insulative housing having a receiving space circumscribed by the upper wall, the lower wall and the sidewalls;

a plurality of contacts assembled to the insulative housing in a back-to-front direction, each contact comprising a contacting portion partially exposed in the receiving space of the insulative housing and a tail portion exposed beyond a rear portion of the insulative housing;

a shielding member assembled to the insulative housing to enclose the insulative housing;

a cable comprising a plurality of signal conductors and drain wires respectively soldered with the tail portions of the contacts; and an insulative cover over-molding rear portions of the insulative housing and the shielding member and a front end of the cable, the shielding member comprises a first shielding half attached to the upper wall of the insulative housing in a direction perpendicular to the back-to-front direction and a second shielding half attached to the lower wall of the insulative housing in a direction perpendicular to the back-to-front direction, and each of the first and the second shielding halves defines a first notch in the rear portion thereof, and wherein the housing forms a first projection to snap into the first notch of each of the first and the second shielding halves.

2. The cable end connector assembly as claimed in claim 1, wherein the first and the second shielding halves each form a pair of wing portions exposed beyond the rear portion of the insulative housing to form a close space, and wherein the front end of the cable and the tail portions of the contacts are respectively exposed in the close space of the shielding member.

3. The cable end connector assembly as claimed in claim 1, further comprising a spacer received in the rear portion of the insulative housing.

4. The cable end connector assembly as claimed in claim 1, wherein the cable comprises a pair of parallel subassemblies, an inner insulative jacket covering the pair of subassemblies, a grounding braid wrapping the inner insulative jacket and an outer insulative jacket surrounding the grounding braid.

5. The cable end connector assembly as claimed in claim 4, wherein each subassembly of the cable comprises a pair of insulated signal conductors, a pair of non-insulated grounding drain wires beside the two signal conductors and a layer of conductive shielding wrapping around the signal conductors and the drain wires.

6. The cable end connector assembly as claimed in claim 1, wherein the shielding member comprises a first shielding half, a second shielding half and a pair of sidewalls vertically connecting with the first and the second shielding halves.

7. The cable end connector assembly as claimed in claim 6, wherein the shielding member is assembled to the insulative housing in said back-to-front direction.

8. The cable end connector assembly as claimed in claim 6, the shielding member comprises an extension portion extending rearwardly from the second shielding half for supporting the solder connection between the cable and the contacts.

9. The cable end connector assembly as claimed in claim 6, wherein the insulative housing comprises a pair of blocks respectively extending rearwardly from rear edges of the upper and the lower walls, and wherein the assembly further comprise a spacer assembled to the housing and received between the pair of blocks.

10. The cable end connector assembly as claimed in claim 9, the spacer is slotted with a plurality of slots, and wherein the tail portions are respectively received in the slots to be soldered with the signal conductors and the drain wires of the cable.

11. A cable end connector assembly comprising:

an insulative housing defining a plurality of passageways extending through a rear face of the housing;

a plurality of contacts inserted into the housing from said rear face with corresponding tail portions rearwardly extending from one edge of the corresponding passageway beyond the rear face;

a spacer abutting against the rear face of the housing to cover rear openings of the corresponding passageways while allowing the corresponding tail portions to extend beyond the rear face, a plurality of partitions and a plurality of slots alternately formed on the spacer with each other, said slots aligned with the corresponding passageways, respectively, in a front-to-back direction so as to have the tail portions of the contacts restrictively received in the corresponding slots, respectively;

a plurality of wires mechanically and electrically connected to the corresponding tail portions of the contacts; and an insulative cover overmolded upon the housing and the corresponding wires, wherein the spacer further includes at least one locking block retainably received in one of the passageways to retain the spacer to the housing in position, and the edge is essentially located in a direction with regard to a center of the corresponding passageway, and the partitions extend from the spacer also in the same direction.

* * * * *